United States Patent [19]

Johnson

[11] Patent Number: 4,599,876

[45] Date of Patent: Jul. 15, 1986

[54] CONTROL MECHANISMS SUITABLE FOR ACTUATING POWER-OPERATED LOCKS

[75] Inventor: Ronald W. Johnson, Essex, England

[73] Assignee: Dover Corporation, New York, N.Y.

[21] Appl. No.: 524,836

[22] Filed: Aug. 19, 1983

[30] Foreign Application Priority Data

Aug. 19, 1982 [GB] United Kingdom ..... 8223884

[51] Int. Cl.[4] ..... E05B 35/00; E05B 19/08

[52] U.S. Cl. ..... 70/344; 70/399; 187/61

[58] Field of Search ..... 70/344–346, 70/395, 396, 399; 187/61, 57

[56] References Cited

U.S. PATENT DOCUMENTS

| | | | |
|---|---|---|---|
| 218,668 | 8/1879 | Dodge | 70/399 X |
| 1,274,313 | 7/1918 | Northrop | 70/399 X |
| 1,369,449 | 2/1921 | Maksym | 70/399 X |
| 2,313,172 | 3/1943 | Rechberger | 187/61 |
| 4,289,001 | 9/1981 | Corfield | 70/346 |

FOREIGN PATENT DOCUMENTS

| | | |
|---|---|---|
| 403826 | 2/1933 | United Kingdom . |
| 652964 | 5/1951 | United Kingdom . |
| 1058161 | 2/1967 | United Kingdom . |
| 2090626 | 7/1982 | United Kingdom . |

*Primary Examiner*—Robert L. Wolfe
*Assistant Examiner*—Russell W. Illich
*Attorney, Agent, or Firm*—Brumbaugh, Graves, Donohue & Raymond

[57] ABSTRACT

A control mechanism suitable for actuating a power operated lock. The control mechanism includes key-engageable surfaces which are shielded from direct access by way of a key-receiving tunnel. The control mechanism is operable by means of a key having a slotted end portion pivotally attached to a shank portion.

5 Claims, 1 Drawing Figure

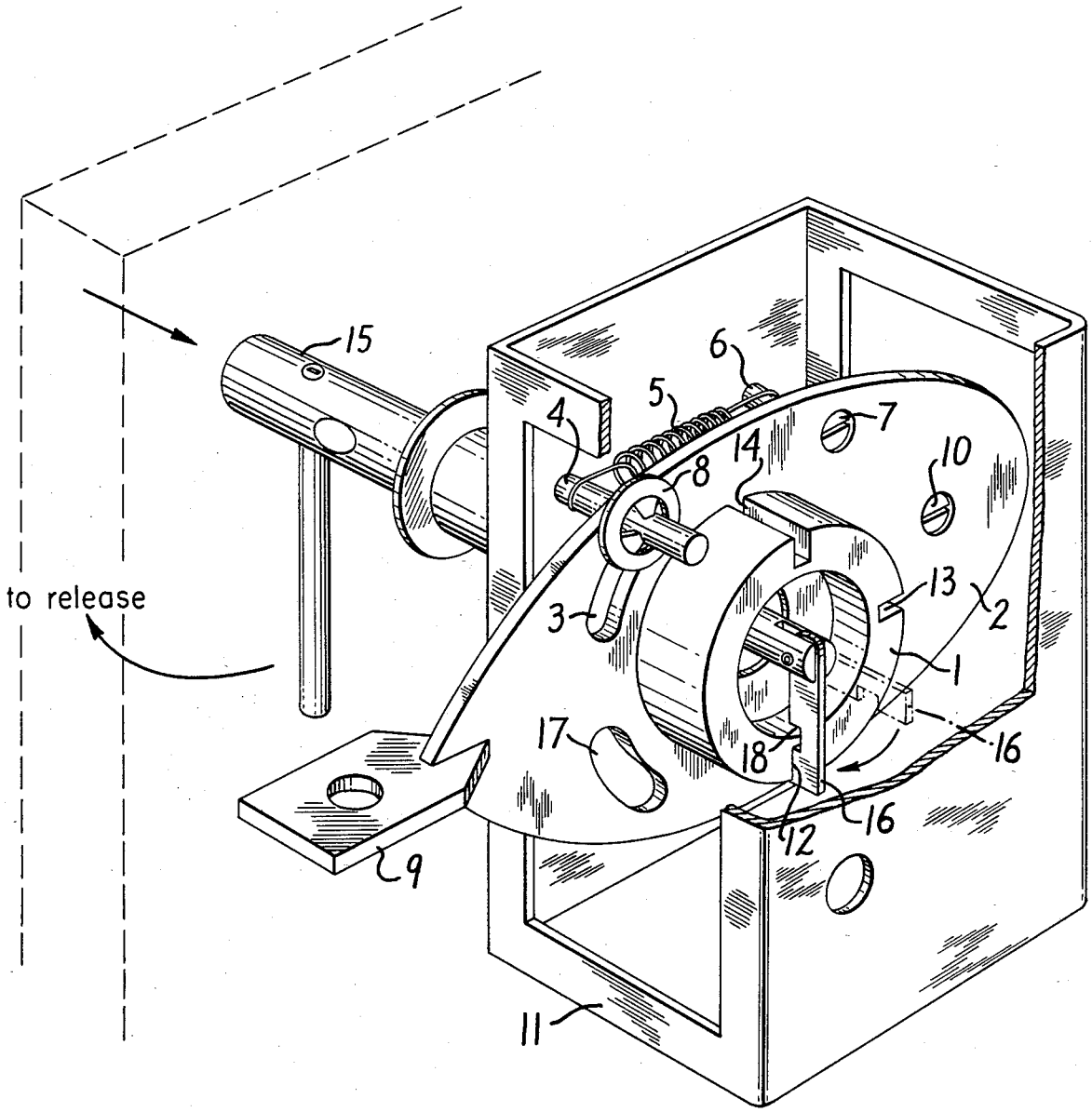
15
6
5
4
7
14
10
8
13
2
3
1
to release
17
18
16
16
12
9
11

CONTROL MECHANISMS SUITABLE FOR ACTUATING POWER-OPERATED LOCKS

The invention relates to a control mechanism which is suitable for actuating a power-operated lock of a landing door of a lift installation.

A lift installation is required to include provision for opening any one or more of the landing doors in emergencies.

Emergency opening of a lift landing door is usually effected by way of a small aperture which provides access from the landing-side of the door to a release member of a power-operated door lock on the shaft-side of the door. Release of the door lock is usually effected by means of a rod capable of passing through the aperture and of being pushed against the release member. A U-shaped aperture is usually used to provide a measure of security against unauthorised operation, but the door lock release member may be operated by way of the U-shaped aperture by a variety of easily available devices.

It is an object of the present invention to provide a control mechanism, suitable for use in a lift landing door, with improved protection against unauthorised operation of the door lock.

According to the present invention, a control mechanism suitable for actuating a power-operated lock, includes:

(i) actuating means movable between a rest position and an operating position.

(ii) key-receiving means having key-engageable surfaces, the key-receiving means being arranged, when moved, to move the actuating means, and, (iii) a hollow member providing an access tunnel to the key-receiving means, the key-engageable surfaces of the key-receiving means being shielded from direct access by way of the tunnel.

The key-engageable surfaces may be shielded from the tunnel by a plane surface of the key-receiving means, thereby preventing operation of the control mechanism by a rod or the like.

The key-receiving means may be a hollow cylindrical member having the key-engageable surfaces on its outer surface and having the hollow member along its inner surface. The inner surface of the cylindrical member shields the key-engageable surfaces from the tunnel.

The key-engageable surfaces may be provided by a longitudinal slot in the outer surface of the cylindrical member. There may be additional slots providing alternative operating positions.

The actuating means may include a beam member pivotally mounted on the hollow member.

The beam member may have an arcuate slot and a pin, engaged in the arcuate slot, may set the limits of rotation of the beam member. A second arcuate slot in the beam member may provide for its rotation in the sense opposite that provided for by the first slot, to provide for alternative arrangements of the control mechanism relative to a power-operated lock.

There may be spring means biassing the actuating means to its reset position. A counterweight may be provided on the beam member, biassing the beam member to its operative position to facilitate operation if the spring means fails.

A striking flange may project from one end of the beam member which may be a plate member.

A key, capable of operating a control mechanism in which key-engageable surfaces are shielded from direct access by way of a key-receiving tunnel, is capable of a first configuration to pass through the tunnel and a second configuration to engage the key-engageable surfaces. The key may include a slotted end portion pivotally attached to a shank portion.

A control mechanism in accordance with the present invention will now be described by way of example only and with reference to the accompanying drawing which is a perspective view of the control mechanism viewed from the rear.

Referring to the drawing, a control mechanism suitable for effecting the operation of a lift landing door lock includes a hollow cylindrical member 1 attached to a beam 2 which is pivotally supported at its central region by means of a spindle (not shown). The hollow cylindrical member 1 is located at the central region of the beam 2 and has three grooves 12, 13 and 14, spaced 90° apart, along it in its outer surface. The beam 2 is a generally elliptical disc mounted orthogonally to the spindle. The beam 2 has an arcuate slot 3. A fixed pin 4 passes through the slot 3, thereby limiting the rotation of the beam 2 according to the length of the slot 3. A coil spring 5 is attached to the fixed pin 4 and to a further pin 6 which is attached to the beam 2 by means of a screw 7. A chip washer 8 is fitted to the fixed pin 4 to retain the beam 2 on the spindle. A rectangular flange 9, orthogonal to the beam 2, projects from the beam 2. At the end of the beam opposite that at which the flange 9 is located, a weight (not shown) is attached to the beam 2 by means of a screw 10. The spindle and the fixed pin 4 are attached to a box-like housing 11 which has means for attachment to a structure in the vicinity of the door lock of a lift landing door. The spindle of the mechanism is hollow. An aperture in the front face of the housing accommodates the spindle. The aperture is D-shaped and the outer periphery of the spindle is of complementary shape in the vicinity of the aperture in order to prevent rotation of the spindle in the aperture. A second arcuate slot 17 provides for an alternative position of the pin 4, positioned through the slot 17.

A suitably dimensioned key 15 is shown inserted, from the front of the housing 11, into the passage through the spindle. The key 15 extends to the rear of the cylindrical member 1. A pivoted arm 16 is provided on the key 15 to facilitate operation of the control mechanism by engagement of the lowest groove 12 in the cylindrical member 1, from the rear, thereby facilitating clockwise rotation of the cylindrical member 1 by means of the key 15. The pivoted arm 16 on the key 15 has a slot 18 which permits engagement of the arm 16 with the groove 12 of the cylindrical member 1. The pivotal attachment of the arm 16 to the key 15 facilitates the insertion and removal of the key 15. The spring 5 urges the beam 2 in an anti-clockwise direction as viewed in the FIGURE (from the rear).

In use, the control mechanism is mounted in the vicinity of the power-operated lock of a lift door, the flange 9 being so positioned that, when the beam 2 is rotated in the clockwise direction as viewed in the FIGURE, the flange 9 will stike the release lever of the power-operated lock.

The direction of movement of the flange 9 relative to a power-operated lock in a lift installation may be varied according to the angular position of the housing 11 of the control mechanism relative to the power-operated lock. With the housing 11 set at the position shown in the FIGURE, the flange 9 is capable of upward movement. With the housing 11 rotated 90° clockwise, as viewed, from the position shown in the FIGURE, the flange 9 is capable of sideways movement to the right. With the housing 11 rotated a further 90° clockwise, the flange 9 is capable of downward movement. The groove 13 comes into operation for sideways movement of the flange 9 and the groove 14 comes into operation for downward movement of the flange 9. Further variation of the direction of movement of the flange 9 relative to a power-operated lock in a lift installation is possible by moving the pin 4 to engage the arcuate slot 17.

The spindle may be made by turning a stainless steel bar to provide a component which is corrosion resistant, robust, and of attractive appearance. The housing 11 may be a pressing from 12 s.w.g. mild steel plate and may be plated to increase its resistance to corrosion. The beam 2 may be a zinc alloy die casting to provide resistance to corrosion and benefits as to cost and quality in batch production.

The size of the passage through the spindle may be selected with a view to increasing the difficulty of effecting operation of the control mechanism with devices other than the specified key. An entry hole of the order of 8 mm. for example, will prevent the insertion of a standard bicycle chain into the control mechanism, while a smaller chain such as a Sturmey Archer bicycle gear chain, though capable of passing through the spindle, cannot engage and turn the cylindrical member 1. Again, with an entry hole of 8 mm. a length of wire with its end turned over will not be capable of reaching any of the slots in the cylindrical member 1 if the slots lie more than 8 mm. from the edge of the passage through the spindle and, in any event, the wire would slide ineffectively along the rear of the cylindrical member 1. The housing 11 also prevents a rod being pushed into the region of the lift well beyond the housing 11.

I claim:

1. A control mechanism for actuating the release member of an elevator installation of the type having a landing door and a power-operated lock with a release member, for manually opening the door, said control mechanism comprising:

a hollow spindle member, having a central axis and opposite ends, to provide a key-receiving tunnel;

a cylindrical member having a hollow interior communicating with said tunnel and mounted for rotation about said axis, the hollow cylindrical member having an inner cylindrical surface and a distal end having at least one key-engageable surface;

actuating means moveable, responsive to rotation of said hollow cylindrical member, between a rest position and an operative position, wherein said actuating means includes a beam member attached to said hollow cylindrical member for rotation therewith; and a key member sized for insertion through said hollow spindle member and hollow cylindrical member, said key member having a rotatable end portion with means to engage said key-engageable surface, wherein said end portion is rotatable between an axially aligned position, for insertion through said hollow spindle member and said hollow cylindrical member, and a second position, generally perpendicular to said axis, into engagement with said key-engageable surface, wherein one end of said hollow spindle member is disposed within said inner, cylindrical surface of said hollow cylindrical member.

2. An elevator installation as defined in claim 1, wherein said hollow cylindrical member includes an outside cylindrical surface, and wherein said key-engageable surface comprises at least one axial slot formed in said outer surface and extending from said distal end.

3. An elevator installation as defined in claim 2, wherein said at least one key-engageable surface comprises a plurality of axially extending slots on said outer surface and spaced around said hollow cylindrical member, whereby said control housing may be oriented at selected variable angles and one of said slots will lie vertically below said axis such that said rotatable end portion of the key can rotate into engagement by gravity.

4. An elevator installation as defined in claim 1, wherein the beam member has an arcuate slot and a pin, engaged in the slot, limits the rotation of the beam member.

5. An elevator installation as defined in claim 4, wherein said beam member includes a second arcuate slot for reorientating said beam member relative to said pin.

* * * * *